US008663405B2

(12) United States Patent
Krajewski

(10) Patent No.: US 8,663,405 B2
(45) Date of Patent: Mar. 4, 2014

(54) STAMPING OF AGE-HARDENABLE ALUMINUM ALLOY SHEETS

(75) Inventor: Paul E. Krajewski, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 362 days.

(21) Appl. No.: 13/011,957

(22) Filed: Jan. 24, 2011

(65) Prior Publication Data

US 2012/0186706 A1 Jul. 26, 2012

(51) Int. Cl.
*C21D 1/00* (2006.01)
*C21D 1/10* (2006.01)
*C21D 1/18* (2006.01)

(52) U.S. Cl.
USPC ..... 148/697; 148/567; 148/574

(58) Field of Classification Search
USPC ..... 148/567, 574, 697
See application file for complete search history.

(56) References Cited

U.S. PATENT DOCUMENTS

| | | | | |
|---|---|---|---|---|
| 4,490,189 | A * | 12/1984 | Develay | 148/694 |
| 5,718,780 | A * | 2/1998 | Bryant et al. | 148/688 |
| 7,260,972 | B2 | 8/2007 | Krajewski | |
| 2002/0174920 | A1 * | 11/2002 | Gupta et al. | 148/537 |
| 2008/0173057 | A1 | 7/2008 | Kruger et al. | |

* cited by examiner

*Primary Examiner* — Brian Walck
(74) *Attorney, Agent, or Firm* — Reising Ethington P.C.

(57) ABSTRACT

A method for enhancing the formability of press-formed high strength, age-hardenable aluminum alloy sheet is disclosed. The sheet is partially formed when in an overaged condition, for example in a T7 or T8 temper condition, to form a preform. After an annealing and solutionizing process the preform is promptly further deformed in a second forming operation and subsequently aged to develop high strength. The method may be employed to form components of more complex shape from higher strength aluminum alloys such as 6000 series and 7000 series alloys.

14 Claims, 4 Drawing Sheets

STAMPING OF AGE-HARDENABLE ALUMINUM ALLOY SHEETS

TECHNICAL FIELD

This invention pertains to methods for forming of age-hardenable aluminum alloy sheet materials into articles of manufacture having complex shapes. More specifically, this invention pertains to methods of stamping over-aged aluminum alloy sheet workpieces into a preform shape, heat treating the preform shape, and then stamping the preform a second time.

BACKGROUND OF THE INVENTION

Many articles of manufacture are formed by stamping sheet metal blanks between opposing, complementary, unheated forming dies carried in a vertical stamping press. In making such articles, the manufacturer considers the shape to be formed, selects a suitable sheet metal alloy and its metallurgical microstructure, obtains stamping blanks of the sheet material, and stamps the parts by closure of the stamping dies on each sheet metal blank or other workpiece. Such stamping practices have long been used in high volume operations to form automotive vehicle body panels and the like. There is a need to reduce the weight of vehicle parts and a concomitant need to form body structures of streamlined shapes, and of complex shapes with deep pockets, sharp angles and other complex three-dimensional configurations. The sheet metal materials used have varied from relatively low-strength, mild steel to higher strength-to-weight materials, such as high-strength steel, aluminum alloys and magnesium alloys.

There is interest in broadening the range of aluminum alloys used in vehicle bodies, particularly higher strength aluminum alloys, to enable yet further mass reduction. Many of these higher strength aluminum alloy compositions tend to harden, even at ambient temperatures, by a process called age-hardening, after they have been prepared in heat-treated sheet form for stamping. The selected aluminum-based alloy composition is cast into a suitable slab and reduced to a specified sheet thickness (often about 0.5 to 5 millimeters) by a sequence of hot rolling and cold rolling steps. The strained sheet material, whether in the form of a coil or of blanks cut for stamping, may be heat treated at the mill, prior to shipping to a user, to soften it for subsequent shaping in a stamping press. But many desirable aluminum-based alloys, such as the 6000 series of commercial aluminum alloys containing, for example, small amounts of magnesium and silicon, and the 7000 series of aluminum alloys containing, for example, copper, magnesium, and zinc, tend to age-harden. The coiled or blanked material slowly hardens at temperatures experienced during varying shipping and storing periods, into metallurgical microstructures from which the less-formable sheet metal cannot be readily stamped into many of the complex three-dimensional shapes wanted for vehicle applications and other articles of manufacture.

There is, thus, a continuing need for improved methods and processes for forming complex parts from such age-hardenable, high strength aluminum sheet alloys.

SUMMARY OF THE INVENTION

Sheet material of the 6000 and 7000 series commercial aluminum alloys (typically containing more than 85%-90% by weight aluminum) usually arrive at a stamping operation in an age-hardened condition in which they are not sufficiently formable to form many wanted complex 3-D shapes for articles of manufacture. The aluminum mill, or other maker of these aluminum-based alloy sheet materials, heat-treats the wrought and strain-hardened sheet material by heating it to a temperature (for example, above 500° C.) at which substantially all of the low-content, alloying constituents (such as one or more of copper, magnesium, silicon, and zinc) are each dissolved as a solid solution in grains of mostly aluminum. This is known as a solution heat treatment or as "solutioning" or "solutionizing." If one could look at the microstructure of the sheet material at this elevated temperature, the alloying elements would be dispersed among the many more aluminum atoms. Few, if any, clusters of alloying constituents would be visible. The aluminum alloy sheet material is then quenched in an aqueous medium or cooled by forced air flow to substantially room temperature (e.g., 20° C. to about 30° C.) to maintain the solid solution of the atoms of alloying elements in a matrix of aluminum atoms arranged as a series of abutting, misaligned crystalline grains separated by grain boundaries. This solid structure of grains of mostly aluminum is referred to as the alpha-phase of the sheet material.

But this alpha aluminum phase is metastable, even at room temperature, and the alloying constituents soon begin to form discernable clusters or particles of a second phase within the alpha aluminum grains and, later, at the boundaries between the grains. The composition and shape of the second phase will depend on the particular combination of alloying elements in the alloy. This separation of the alloying constituents with the passage of time increases the strength of the sheet material and reduces its ductility, a metallurgical phenomenon known as age-hardening. Age-hardening occurs at room temperature, or at ambient temperatures experienced upon shipping and storage of the sheet material. Age-hardening is accelerated by any increase in temperature experienced by the sheet material. With the typical passage of time between the solution heat treatment and quenching at the aluminum mill and the shaping of the sheet material in a stamping plant, the naturally-aged aluminum-alloy sheet stock reaches a hardened T4 temper code state (an Aluminum Association code designation). In this condition the alloy sheet possesses limited formability and may be formed into a less complex shape such as a hood outer panel. However an alloy in a T4 condition is not readily formable by stamping into a complex three-dimensional shape without some visible damage to the sheet such as tearing, necking, or splitting.

In accordance with embodiments of this invention, such age-hardening aluminum alloys are processed in a different manner in order to stamp the sheet material into more complex and deformed shapes. Instead of worrying about the natural age-hardening of such sheet materials, the aluminum alloy sheet material is intentionally over-aged prior to a first stamping step. During making of the age-hardenable aluminum-based alloy sheet, the sheet is rolled to a desired gage, and then solution treated in a continuous heat treating line and quenched. The softened aluminum alloy sheet material is then intentionally over-aged, past its peak strength, to a strength level that has decreased to less than about ninety percent of its attainable peak aging strength. This over-aging process may be accomplished by managed heating of the sheet material to accelerate aging, or by straining the sheet material followed by managed heating to achieve over-aging. The goal of this step is to bring the aluminum alloy sheet material to a T7 or T8 temper code state as recognized by the Aluminum Association. Suitable practices for attaining such over-aging of the aluminum-based alloy sheet material for use in embodiments of this invention will be described in more detail below in this specification. But it is found, surprisingly, that the forming characteristics of such over-aged aluminum sheet materials are often superior to the forming characteristics of the T4 temper state material used in prior conventional stamping practices.

The over-aged aluminum alloy sheet blank material is then subjected to a first stamping step to form the blank into a preform shape. The preform shape is a precursor of the desired final sheet metal shape to be attained by stamping. In many embodiments of the invention, the desired final shape of the article that is to be attained by stamping will be analyzed with respect to the measured forming characteristics of the selected over-aged aluminum alloy sheet metal stock. In general, it may be preferred to maximize the shaping of the preform to bring it as close to a desired final stamped shape without damaging the aluminum alloy material in this preform stamping step. Examples of such damage include strain localization, necking and fracture.

The aluminum alloy preform shape is then removed from the stamping dies as may be necessary to solution heat treat the preform shape. A selected strained portion of the preform metal or the entire preform metal shape is rapidly heated close to, or above, the solution temperature for the alloying constituents of the aluminum-based alloy. Such heating is continued briefly until such solutioning is suitably and reliably attained. For example, this may be accomplished by briefly exposing the preform to an elevated temperature, for example 400° C. or higher for between 10 seconds and 1 hour. After sufficient time at this elevated temperature, the preform may be rapidly cooled to room temperature to substantially retain the dissolved alloying elements in an alpha phase solid-state solution.

The heat treated preform is then returned to a suitable unheated stamping press (the same or a different press) for completion of the shaping of the article as intended to be attained by stamping. Obviously, trimming or piercing of the stamped article may be later performed, or other desired shaping operations.

The stamped/formed article may then be naturally or artificially aged and strengthened to a desired condition for its use. For example, in many automotive body assembly operations, a body-in-white will be subjected to several painting operations and the stamped part, now comprising part of the welded-together body structure, will be repeatedly heated in paint bake ovens at temperatures that accelerate age-hardening of the stamped part or parts now incorporated into the vehicle body structure.

In accordance with embodiments of this invention, an aluminum alloy stamping blank is generally considered to be suitably over-aged when, on continued aging, its strength declines rather than increases. For practice of this invention it is expected that the strength of the over-aged alloy will be less than 90% of the strength of the peak-hardened alloy.

Suitable alloys for practice of the invention include the magnesium and silicon alloyed 6000 series aluminum alloys, for example, 6013, 6014, 6111 and 6022, or the zinc-magnesium-copper alloyed 7000 series aluminum alloys, for example 7050, 7075 and 7150. As stated above in this specification, an important step in the practice of the subject two-step stamping methods is that the aluminum alloy stamping blank be prepared in a suitably over-aged state prior to stamp-forming of the aged sheet metal blank into a desired preform shape.

A suitable heat treatment scheme for producing the preferred initial microstructure in 6000 series alloys, and generally corresponding to an over-aged T8 temper, may comprise holding the sheet metal material at a temperature of about 535° C. for about one hour, followed by cooling at a rate sufficient to retain the alpha phase solid solution of the alloying elements. This heat treatment may, optionally, be followed by some natural aging at ambient temperature prior to applying some limited pre-strain, e.g., up to about 5% strain to the sheet, for example, by tension or roller leveling. The pre-strain may be followed by a two-step aging procedure involving a first aging treatment at 175° C. for about 6 hours followed by a second aging step conducted at about 250° C. for about 8 hours followed by slow cooling.

Another suitable heat treatment for a 6000 series alloy may be a similar solution treatment of holding at a temperature of about 535° C. for about one hour followed by rapid cooling. A suitable aging treatment may be holding at a temperature of about 175° C. for about 12 hours. The aging treatment may optionally be preceded by some room temperature aging. This would correspond to a first T7 over-aging treatment.

Another suitable heat treatment for a 6000 series alloy may be a similar solution treatment of holding at a temperature of about 535° C. for about one hour followed by rapid cooling. A suitable aging treatment may be holding at a temperature of about 250° C. for about 12 hours. The aging treatment may optionally be preceded by some room temperature aging. This would correspond to a second suitable T7 over-aging treatment.

Thus, suitably over-aged aluminum alloy sheet materials may be formed into complex shapes in a method comprising a preform stamping step, an intervening solution heat treatment of the preform shape, and one or more stamping steps to attain a final stamped shape. The final shape may be strengthened by natural or induced age-hardening.

Other objects and advantages of the invention will be apparent from descriptions of preferred embodiments which follow in this specification.

DESCRIPTION OF PREFERRED EMBODIMENTS

Increasingly, lower-density (than mild steel), stamped, sheet aluminum alloys, typically of thickness between about 1 and 2.5 millimeters, are being substituted for mild steel in vehicle bodies and closure panels, including hoods, trunklids, doors and rear hatches, in an on-going effort to reduce vehicle mass. Many aluminum alloy stampings have strengths comparable to those of the mild steel stampings they replace so that mass reduction primarily results from the lower density of aluminum. It is clear that yet further mass reductions may result from more extensive application of higher strength, age-hardened aluminum alloys.

Age-hardening is a preferred process for hardening and strengthening aluminum alloys and involves a series of heat-treatment steps or operations. These steps first place an alloy in a suitable condition for age-hardening and then enable such age-hardening.

Figure 1:
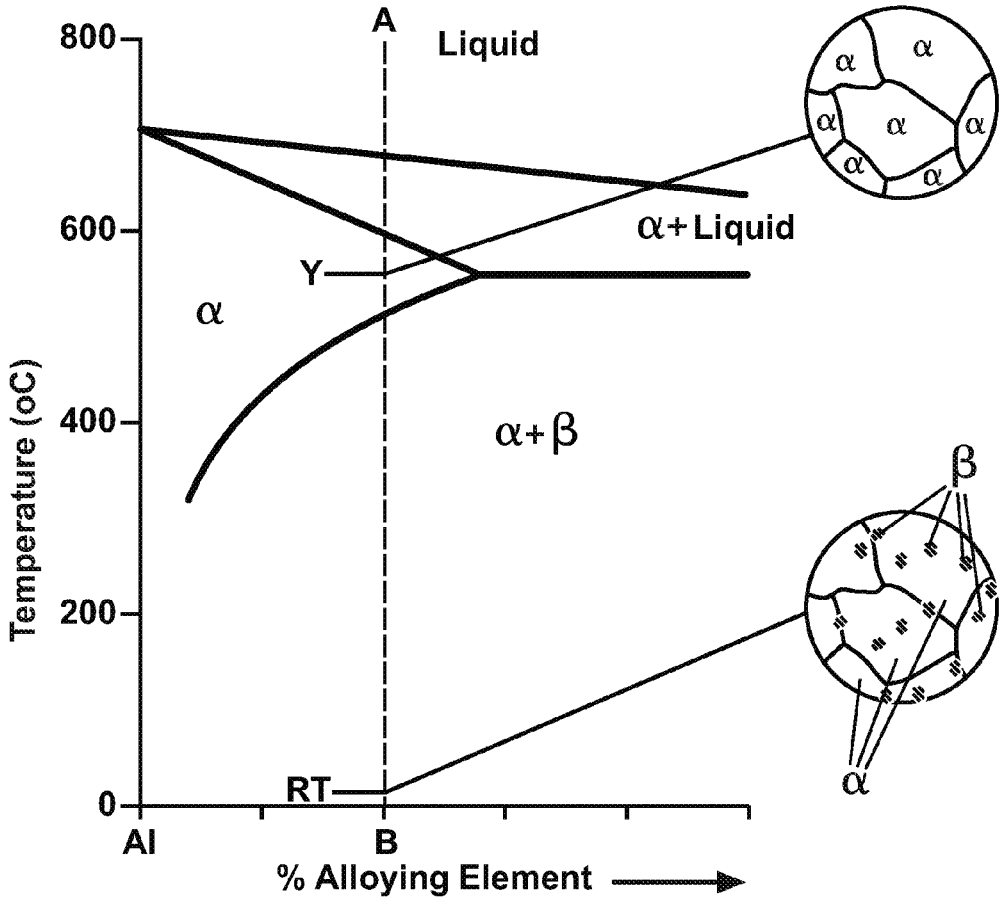
FIG. 1 shows a representation of the aluminum-rich portion of a generic phase diagram for a representative age-hardening aluminum alloy illustrating the temperatures, alloy composition and associated microstructures for a solutionizing heat treatment.

The first step is to dissolve substantially all of the intentionally-added alloying elements which may include magnesium, silicon, zinc and copper in a solutionizing process. The major aspects of the solutionizing process are schematically depicted in FIG. 1 which shows the aluminum-rich portion of a generic aluminum-(alloying element) phase diagram. Commercial aluminum alloys, as indicated subsequently in Table 1, comprise multiple alloying elements and impurities. However the simplified phase diagram shown in FIG. 1 is adequate to describe, in outline, the fundamentals age-hardening process even in these more complex commercial alloys.

At room temperature, about 25° C., (shown as RT on FIG. 1) an alloy with an (alloying element)-content indicated by line AB, will comprise a predominantly aluminum matrix ($\alpha$) with a plurality of substantially-aluminum grains separated from one another by grain boundaries as depicted in the associated inset. At room temperature, the aluminum matrix has only a limited capability to dissolve these alloying elements. When the substantially-aluminum matrix has dissolved as much of the alloying elements as it can hold, the remainder of the alloying elements, typically an appreciable fraction of the total alloy content, will be present as particles, here shown as $\beta$. These particles, often intermetallic compounds formed by reaction of the alloying elements with one another, or with aluminum, may form within the grains or on the grain boundaries, as shown.

At elevated temperatures, for example at temperature Y in FIG. 1 the substantially-aluminum matrix can accommodate more of the alloying elements in solution. In particular, at a temperature of about 500° C. or greater, the aluminum-rich matrix can accommodate essentially all of the alloying elements in solution. So, by heating an aluminum alloy to about 500° C., and holding for sufficient time, typically for about an hour, a generally chemically homogeneous aluminum-based solid solution ($\alpha$ in the associated inset) may be formed as the particles dissolve and the alloying elements diffuse into the aluminum. This is a solutionizing treatment. Preferably only minor growth of the $\alpha$ grains occurs so that, as shown in FIG. 1, the room temperature grain structure is substantially retained during the solutionizing treatment. This aluminum solid solution ($\alpha$) is thermodynamically stable only at the solutionizing temperature (Y) of about 500° C. However because both particle dissolution and formation require diffusion, or thermally-activated atomic motion, the alloy-rich aluminum solid solution may be retained, temporarily, by rapidly cooling or quenching the alloy into water at room temperature or about 25° C. to 'freeze' the alloying elements in position and maintain them in solution.

The solutionized condition is only metastable at room temperature, and, over time, the alloy will 'age'. During aging, the dissolved alloying elements will precipitate from the aluminum matrix, often as alloying element-rich clusters or as intermetallic compounds, in the form of small, dispersed particles. These particles may be generally shaped as spheroids, rods or plates depending on the alloy system, and will, over time, grow in size and reduce in number. Growth occurs relatively slowly at room temperature but may be accelerated at elevated temperatures, of, say, up to 250° C., so that a wide variety of time-temperature combinations will result in comparable particle growth.

These dispersed particles or precipitates strengthen the aluminum matrix to a degree which depends on their shape, size and distribution. Particularly small, (10-30 nanometers) closely spaced, or particularly large (500-1000 nanometers) widely distributed particles are less effective in strengthening the matrix than particles of intermediate size (100-300 nanometers) and spacing. When maximum particle strengthening occurs, the alloy is considered 'peak aged' and exhibits its highest strength. Continued aging, beyond the peak aged condition, results in continued particle growth, rendering the particles less effective in strengthening the alloy, and reducing alloy strength. In this condition, the alloy is termed 'overaged'.

Paralleling this change in microstructure are changes in the strength and ductility of the alloy. In its water quenched state the alloy will be of low strength and will generally exhibit high formability. With the development and evolution of the particles on aging, the alloy will initially harden and exhibit lessened ductility and formability but will eventually begin to soften and regain some of its lost formability if aging is continued for a sufficiently long time.

Overaging is not a uniquely defined state and an overaged alloy may exhibit a wide range of strengths. The only requirements are that its strength is less than its peak aged strength, and that the aging time is longer than the time to achieve the peak aged condition. In practice of this invention, an overaged alloy will be considered to be an alloy whose yield strength is less than about 90% of the yield strength of the same alloy in its peak aged condition. Such a requirement may be met by alloys in the T7 temper and by alloys in an overaged T8 temper.

Figure 2:
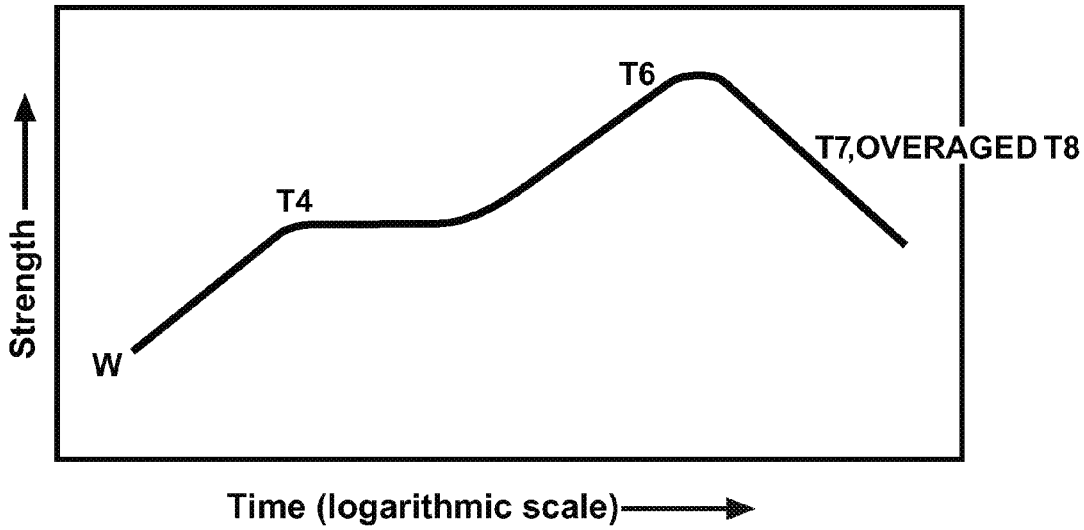
FIG. 2 shows a representation of the evolution in strength during aging of an age-hardening aluminum alloy with (logarithm of) aging time.

In common terminology the alloy in its water quenched, solutionized condition is designated as "W"; when the solutionized alloy is aged at room temperature is designated as "T4"; when the solutionized alloy is aged at elevated temperature it is designated as "T6". Other terms include "peak aged" for the condition at which the alloy achieves it maximum strength while the designation "T7" refers to "overaged" alloys resulting from continued aging of a "peak aged" alloy. "T8" tempers generally refer to aged alloys which have been deformed, to some limited extent, say 5% strain, prior to aging. In practice of this invention the term 'overaged T8' temper will refer to an overaged alloy which has been strained prior to artificial aging. These designators may be better understood by reference to FIG. 2, a representative strength versus aging time curve, which generally associates these terms with alloy strength. Age-hardenable alloys may be heat treated to develop a range of strengths, and, often, the goal is to achieve the highest possible strength consistent with processing capabilities. When age-hardenable aluminum alloys are used in motor vehicle bodies, these alloys may be used at lower strength than is achieved in the peak aged condition. Any increase in strength resulting from aging however, will reduce the ductility or formability of the alloy.

In an embodiment, an age-hardenable aluminum alloy sheet may be formed in a two-step forming process. The first forming process is conducted on an alloy in the T7 or over-aged T8 temper (FIG. 2) alloy and the second forming step is conducted on a solutionized alloy (W—FIG. 2) in which the intentionally-added alloying elements are substantially or completely dissolved in the aluminum-rich matrix. Subsequent to the second forming step the solutionized alloy may be aged, either at room temperature or at elevated temperature, possibly during a paint bake cycle, to develop increased strength.

Figure 3:
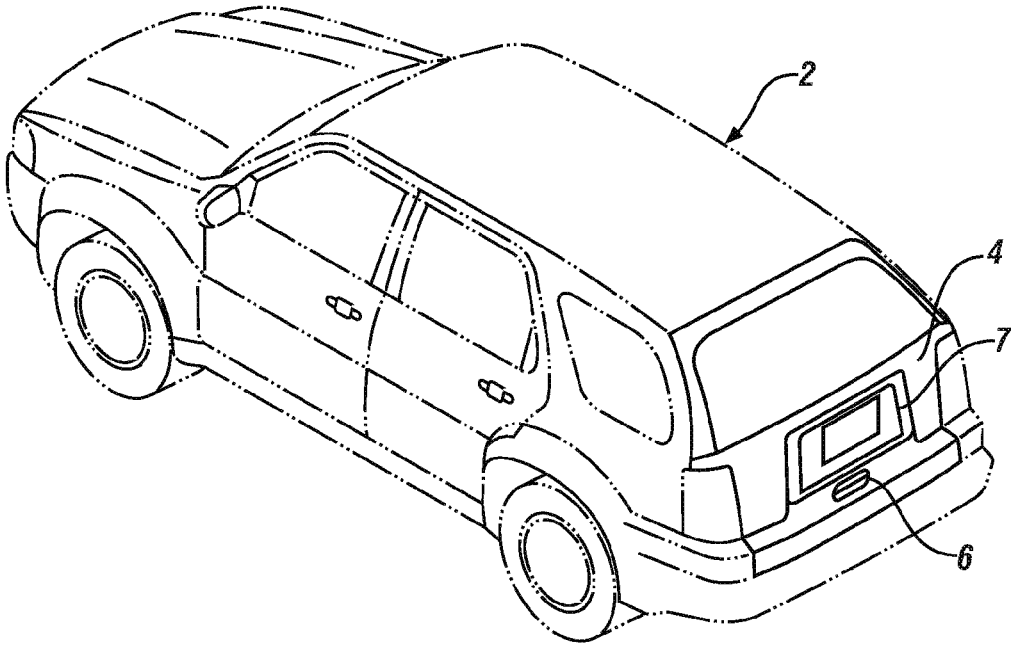
FIG. 3 shows in overhead, rear, three-quarter view an SUV-like vehicle with a liftgate.

An example of a stamped part which might benefit from the practice of this process is the inner panel of a liftgate such as may form the rear closure of a van or an SUV. FIG. 3 shows an exemplary liftgate 4, as installed on an exemplary SUV-style vehicle 2 (shown in ghost).

The liftgate is assembled from an inner panel and an outer panel. The outer panel is the visible portion seen in FIG. 3 and is generally smoothly curved with cavities or recesses 6, 7 to accommodate features like a handle for operation of a liftgate opening mechanism (cavity 6) and the vehicle license plate (cavity 7). The inner panel, which faces into the vehicle, but is often hidden from view by a decorative covering, generally serves to support and reinforce the outer panel. The inner panel may contain features which mirror or complement the features of the outer panel. The inner panel may also incorporate an extensive and deep, up to about 200 millimeter, cavity suited to accommodate mechanisms and actuators commonly found in the tailgates of vans and SUVs. These mechanisms and actuators may include a door locking mechanism, a window lift mechanism, and/or a rear wiper mechanism, or the like.

Both the inner panel and the outer panel of such a liftgate, and many other sheet metal parts may be fabricated by press-forming or stamping. In this process, a blank, commonly a flat metal sheet is shaped by being placed between two die portions of complementary shape, which close upon one another under the influence of a press, and impart the desired shape to the sheet positioned between them. Because stamping presses almost universally act in a vertical direction, the die portions are commonly designated as the upper and lower die.

Such stamping dies have a shape-imparting region and a binder region. The shape-imparting region imparts the desired shape to the sheet or preform. The binder region of the die acts on a region of the blank or preform, the binder, which controls and facilitates the forming process. The binder is removed or trimmed after forming. Often such die binder regions incorporate drawbeads, linear complementary features, one protuberant and convex, the other recessed and concave, mounted opposite one another on the upper and lower portions of the dies. Drawbeads are effective in restraining the lateral sliding of the sheet across the die and may be adjusted to apply lesser or greater restraint as required.

Since the binder is removed from the blank or preform after the final forming step, the extent and shape of the binder on the preform and the fully-formed component may be different. Also, the binder portion of the die may be modified between the first and second forming steps even if dies with common shape-imparting portions are used for the preformed and fully-formed shapes. For example, the location and number of drawbeads, as well as the degree of restraint they offer, may be different in each of the forming steps.

Figure 4:
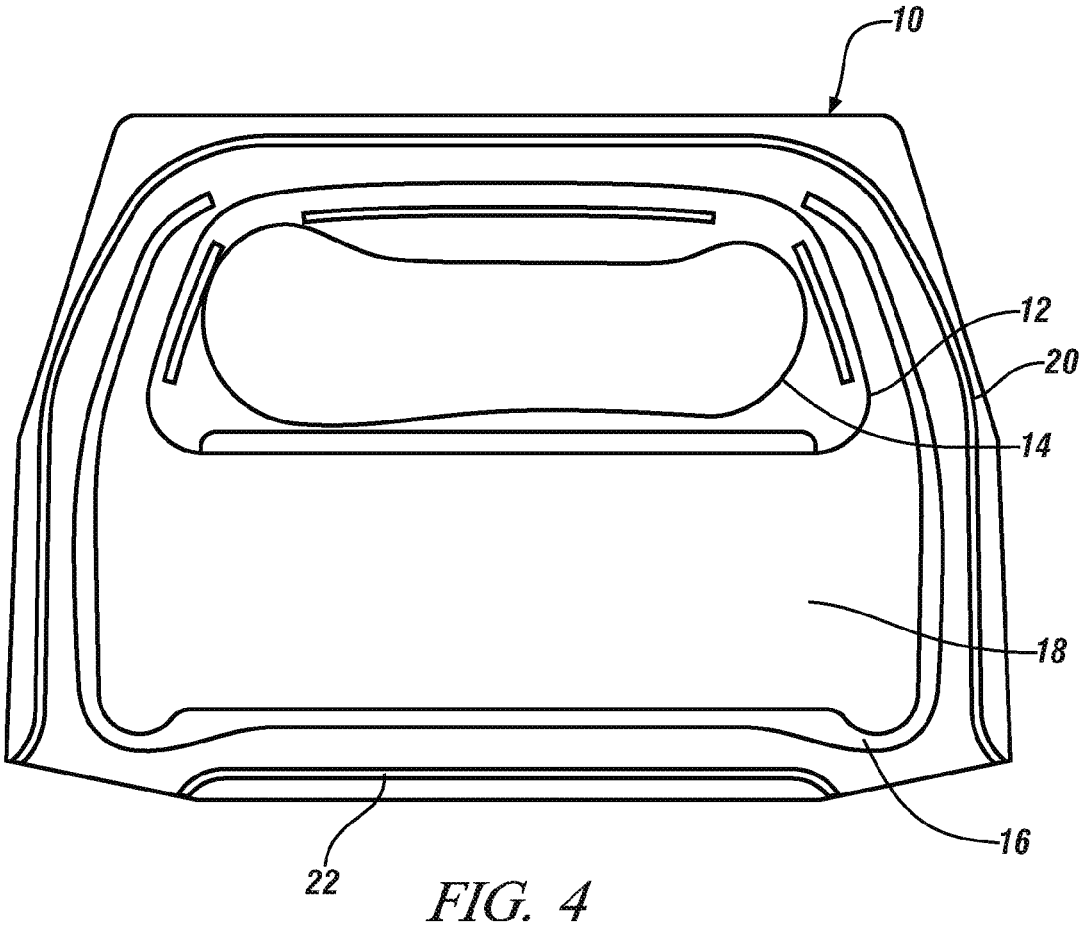
FIG. 4 shows, in plan view, a representation of a stamped, pre-formed inner panel from a liftgate. The panel is shown as it would appear after removal from the forming die.
Figure 5:
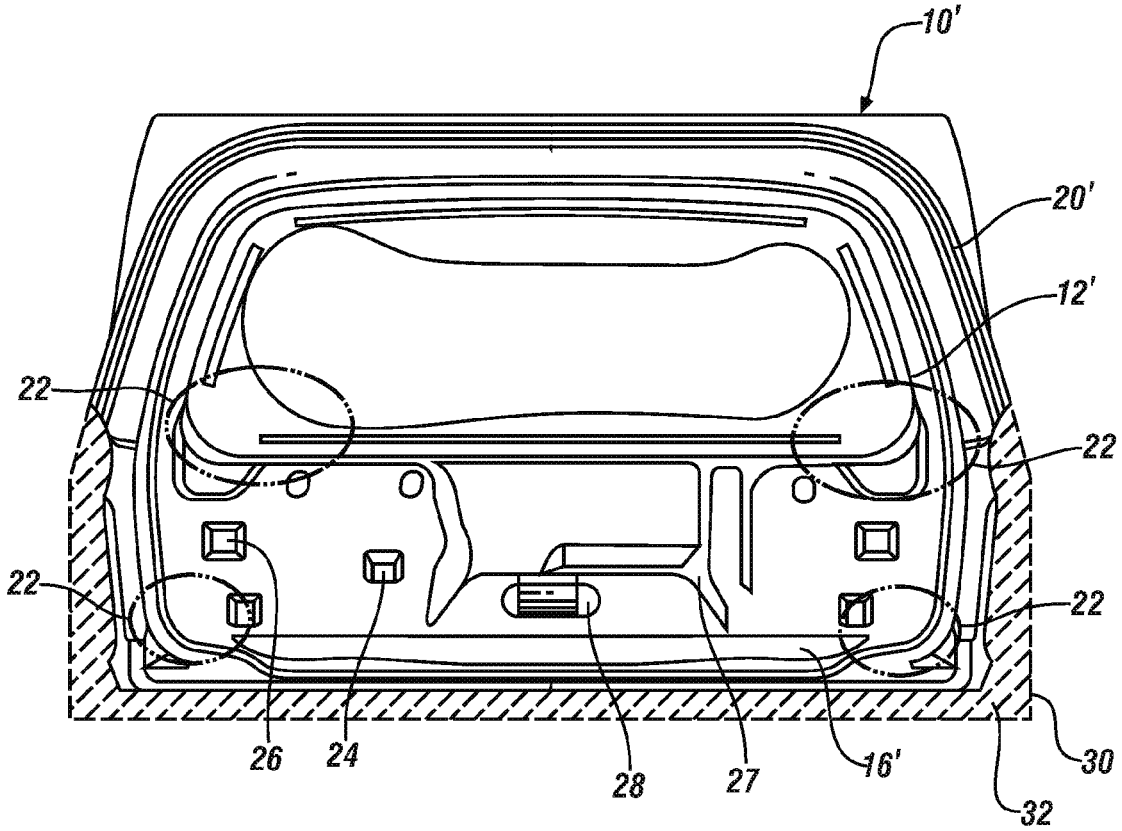
FIG. 5 shows, in plan view, a representation of a stamped, fully-formed inner panel from a liftgate. The panel shown has been stamped from the preform panel shown in FIG. 4 and as it would appear after removal from the forming die.

FIGS. 4 and 5 show a representative liftgate inner panel such as might be employed as a rear closure on an SUV like that shown in FIG. 3. In a first step, conducted on an overaged alloy, and illustrated in FIG. 4, a preform 10 which incorporates many of the general features of the liftgate inner panel is shown. Features such as window opening 12, partially cut out at 14, as well as wall 16 which, on the bottom and sides, bounds recess 18 may be clearly distinguished.

The panel, as shown, is representative of a panel as it exits a forming die and includes the binder. Hence additional features, not normally seen on the panel when installed into the vehicle, are apparent. These features include the imprints 20, 22 made on the sheet by drawbeads, linear features to control the lateral flow of the initially-flat metal blank during forming.

At this stage, a generally flat overaged sheet of shape similar in outline to the outline of the preform has been formed into preform 10. Preform 10, in turn, may be viewed as a 'blank' to be re-inserted between dies in a sheet metal stamping press and further shaped into the fully-formed part. But, prior to being formed into the fully-formed part the panel will be subjected to a solutionizing heat treatment which will also at least partially anneal the panel to restore ductility and formability to the alloy as described below.

FIG. 5 shows the same panel after it has been solutionized and formed to final shape. In fully-formed panel 10', many features similar to those shown in preform 10 are evident, but the features have been further developed. For example wall 16' and window opening 12' have been deepened and additional features incorporated compared to wall 16 and window opening 12 of FIG. 4. Some specific points of difference between walls 16' and 16 and window openings 12' and 12 are highlighted by dotted ovals 22 which identify sharply bent, deep, corner sections which are challenging to form. Also additional features including pockets, such as at 24 and 26 and provision for features 27, 28 complementary to the license plate holder (cavity 7, FIG. 3) and door handle depression (cavity 8, FIG. 3) of the outer panel have been introduced.

Some modification of the blank dimensions and shape may occur between the preform and the fully-formed part. Comparison of FIGS. 4 and 5 indicates that the hatched portion 32 bounded by dotted line 30 has been removed from the preform blank 10 of FIG. 4. Similarly, it may be noted that drawbead imprint 20' of FIG. 5 differs from drawbead imprint 20 of FIG. 4. Specifically drawbead imprint 20' shows a double drawbead imprint while drawbead imprint 20 shows only a single drawbead imprint; also, drawbead imprint 20' is less extensive than drawbead imprint 20 due to the material 32 removed from preform panel 10 to create fully-formed panel 10'. Further drawbead imprint 22, shown in the preform of FIG. 4, is absent from the fully-formed blank of FIG. 5.

Note that the drawbead imprint 20 of FIG. 4 will not typically be removed or erased as the preform is further formed to the fully-formed component. Thus the double drawbead imprint 20' of FIG. 5 does not necessarily indicate that two drawbeads were employed in the second, fully-formed, forming step. However, it will be appreciated by those skilled in the art that the process, as described, enables changes in any or all of the number, the geometry and the placement of drawbeads in progressing from stamping the preform to stamping the fully-formed component.

Removal of material from the preform may be readily accomplished using a trim die, in which matched cutting edges, arranged in opposition and actuated by a press, engage the sheet. In high volume production this method would be preferred, but any method of removing metal including sawing, nibbling or shearing may be employed without limitation.

The ability to modify the preform 'blank' outline and to modify the drawbeads or any other die or part features offers yet further opportunity to form complex shapes. These modifications may influence the distribution of deformation in the part. It is therefore feasible, by using different shapes and die drawbead configurations, among others, during the preform and fully-formed stamping steps, to selectively, and more efficiently, allocate deformation in the part and enable forming of more complex parts. Thus modification of the preform shape in the binder or of the blank-holding features, such as drawbeads, of the dies in the binder region, may be beneficially-incorporated in the two-step forming process and are comprehended in the scope of the invention.

Suitable alloys for the just-described procedure may include those with magnesium and silicon as major alloying elements and generally described as 6000 series aluminum alloys for example alloys designated as 6013, 6014, 6111 and 6022. Other suitable alloys include those alloyed primarily with zinc, magnesium and copper, commonly known as 7000 series aluminum alloys, for example 7050, 7075 and 7150. Representative compositions of these alloys are shown in Table 1.

TABLE 1

Compositions of selected aluminum alloys in weight percent (Balance Aluminum)

| | Alloy | | | | | | |
|---|---|---|---|---|---|---|---|
| Element | 6013 | 6014 | 6022 | 6111 | 7050 | 7075 | 7150 |
| Cr | <0.1 | <0.2 | <0.1 | <0.1 | <0.04 | 0.18-0.28 | <0.04 |
| Cu | 0.6-1.1 | <0.25 | 0.01-0.11 | 0.5-0.9 | 1.7-2.4 | 1.2-2.0 | 1.9-2.5 |
| Mg | 0.8-1.2 | 0.4-0.8 | 0.45-0.75 | 0.5-1.0 | 1.7-2.6 | 2.0-2.9 | 2.0-2.7 |
| Si | 0.6-1.0 | 0.3-0.6 | 0.8-1.5 | 0.6-1.1 | <0.12 | <0.4 | <0.12 |
| Zn | <0.25 | <0.1 | <0.25 | <0.15 | 5.7-6.9 | 5.6-6.1 | 5.9-6.9 |
| Fe (as impurity) | <0.5 | <0.35 | <0.2 | <0.4 | <0.15 | <0.5 | <0.15 |
| Other | <0.25 | <0.75 | <0.45 | <0.15 | <0.45 | <0.7 | <0.35 |

While there may some differences in the response of different alloys in an alloy series and in the response of different alloy series, such alloys may generally be solutionized at a temperature of about 500° C. by holding them at that temperature for 30 min. to dissolve at least any particles containing the major alloying elements. After quenching, and overaging by one of several thermal treatments described more fully later, the alloy sheet will be in an overaged condition and exhibit superior formability than if it were in the peak aged condition.

In this condition, the sheet is press-formed to a pre-form which, like the example shown in FIG. 4, is intermediate in shape between a flat sheet and the final component. Obviously, such a pre-form may exhibit a wide range of shapes. The preform may be formed using matched dies intended to produce the preform shape when fully closed on one another. Alternatively the pre-form may be produced on the dies shaped and constructed to form the final part by arresting the press action before it reaches its maximum stroke and the upper and lower die fully close on one another. Irrespective of which procedure is followed, it is essential that the pre-form be suitable for further deformation to attain the final desired shape.

Sheet metals exhibit a forming limit, that is, a condition corresponding to imminent failure, by fracture, of the sheet. Such imminent failure is usually signaled by the development of a deep trough or groove in the sheet surface. Once such a groove or trough, more commonly described as a local neck, or, simply a neck, has developed, even minimal further deformation will cause the neck to develop further into a fracture. Once a neck has developed, fracture on further deformation cannot be forestalled or delayed by heat treatment. Thus, it is required that the shape of the preform be selected to at least avoid necking. Of course, tears or fractures in the preform are likewise unacceptable.

In addition to necks, tears and fractures, those skilled in the stamping arts recognize that the portion of the blank which contacts the shape-imparting die section, may exhibit characteristics which may render them, visually or functionally, unsuitable for their intended use. Examples include wrinkles or waves in the part, folded or bent-over metal, 'loose metal' or regions of minimal stiffness, spring-back or elastic relaxation leading to deviation from design dimensions and cracks, among others. Many of these features may be eliminated upon further forming. Thus the occurrence of some of these features may be tolerated in the preform since it will be subject to a second forming operation where the features may be eliminated. However the shape of the preform should be selected to ensure that folded metal, cracks, tears and necks are absent in that section of the blank corresponding to the finished part. Preferably, the total deformation required to form the finished part will be suitably apportioned, generally equally apportioned, between the step of transforming the initial sheet to the preform and the step of transforming the preform to the final part.

After forming, the preform may be subjected to further heat treatment by heating to between 400 and 500° C., for up to 10 minutes, but preferably for periods as short as 10 seconds, followed by quenching. The heating may be applied to the entire preform, for example by holding it in a furnace, or local heating, for example localized induction heating, may be employed only in those regions of most intense deformation. Where only local heating is employed it may be feasible to conduct such heating without removal of the preform from the die. For example, it may be feasible to incorporate an electromagnetic induction coil in the die or to open the die and position such an induction coil, mounted on a separate structure, proximate to the part. Such local, in-die heating, if it employed short thermal cycles of say 10-30 seconds, could minimize production disruptions and permit a near-continuous processing scheme, whereas furnace treatment would better lend itself to batch processing.

Such a thermal treatment will serve a double purpose. It will serve to at least partially anneal the preform and, undo at least some of the effects of the cold work which occurred during the stamping of the preform and so restore ductility to the preform. In addition, with appropriate choice of overaged condition, described more fully later, the preform may be transformed into a solutionized condition and exhibit enhanced formability relative to its formability in a peak aged condition. The solutionized preform may then be press-formed to final shape. Preferably only limited time, say less than 24 hours, will elapse between the solutionizing heat treatment and press-forming to limit the extent of room temperature aging which occurs prior to forming.

Lubricants are commonly, but optionally, used during sheet metal forming. If lubricants are employed in practice of this invention it is preferred to wash or degrease or otherwise remove the lubricant used in the preform stage prior to the solutionizing heat treatment and re-apply lubricant after solutionizing for the final forming operation.

The formed part may be aged to develop higher strength. The aging process may be selected to develop maximum strength, corresponding to a peak aged condition but alternative aging treatments, even those which do not achieve maximum strength, may be employed. Aging may be performed on the formed part either prior to or after its assembly into a motor vehicle. Aging may occur at room temperature or at elevated temperature and aging may be accomplished by thermal treatments intended and optimized for other purposes.

For example, assembled motor vehicle bodies, generally known as bodies-in-white, are subjected to a series of cleaning and coating (painting) operations intended to convey corrosion protection and a pleasing appearance. The coatings, which may be applied from liquid baths or as solid or liquid sprays, are not functional or robust as-applied, and must be 'baked' to develop the desired pleasing appearance and durability. This 'paint bake' process calls for the body-in-white to be exposed to a temperature of between about 160° C.-200° C. for a period of up to an hour, but, more commonly, for between 20 and 30 minutes. It will be appreciated that the paint bake cycle will be very effective in aging the formed part.

The practices of the invention may be further understood by reference to the following examples. Consider first the following exemplary procedures for producing overaged aluminum alloy sheet materials that have a strength that is suitably less than peak aged strength. Preferably the overaged aluminum alloy materials have a strength that is less than about ninety percent of their maximum strength attained by age-hardening processes.

Example 1

Figure 6:
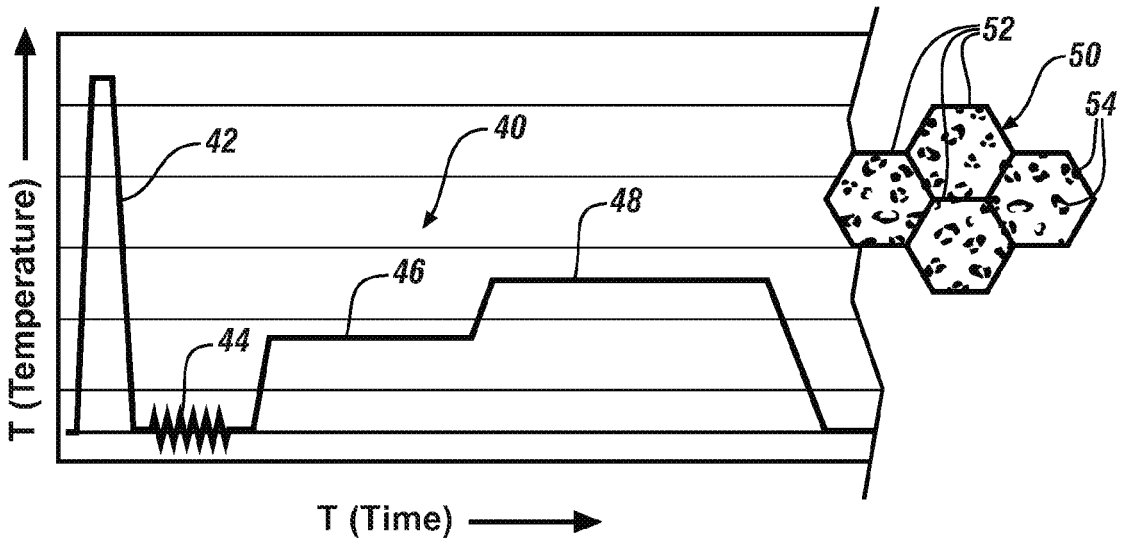
FIG. 6 shows a schematic time-temperature profile and resulting microstructure generally corresponding to an over-aged T8 aging treatment comprising: holding at a temperature of about 535° C. for about one hour and quenching; pre-straining to about 5% strain; and, aging at 175° C. for about 6 hours followed by aging at about 250° C. for about 8 hours.

A 6xxx series overaged aluminum sheet (e.g. 6014) in an overaged T8 temper may be prepared by practice of the thermal treatment 40 shown in FIG. 6 and comprising:

a solution treatment 42, conducted at a temperature of about 535° C. for about one hour followed by quenching into water at room temperature or about 25° C.;

a pre-strain or deformation step 44, performed at about room temperature, which could be practiced by tension or roller leveling the sheet or by a light roller pass imparting about 5% thickness strain to the sheet;

a first aging step 46, comprising exposing the sheet to a temperature of about 175° C. for about 6 hours; and an overaging step 48, comprising exposing the sheet to about 250° C. for about 8 hours.

This process will promote the microstructure schematically shown at 50 where coarse precipitates 54 are formed substantially within aluminum grains 52.

Example 2

Figure 7:
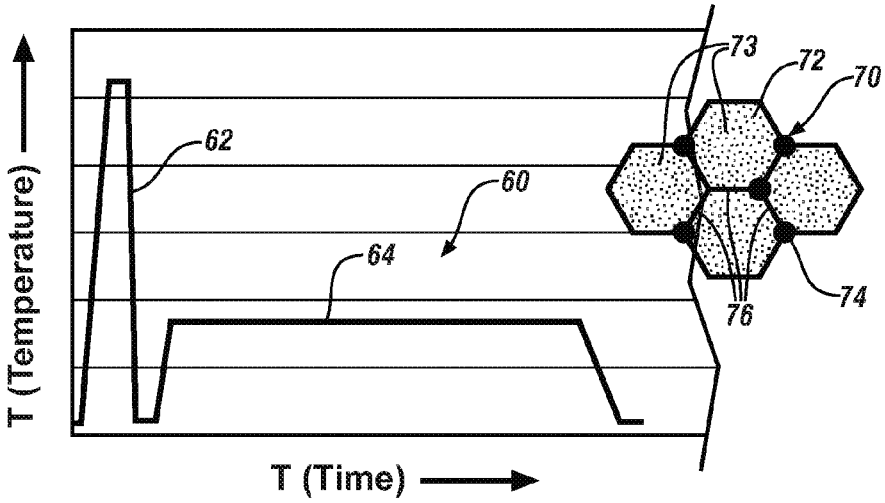
FIG. 7 shows a schematic time-temperature profile and resulting microstructure generally corresponding to a T7 overaging treatment comprising: holding at a temperature of about 535° C. for about one hour and quenching; pre-straining to about 5% strain; and aging at 175° C. for about 12 hours.

A 6xxx series overaged aluminum sheet (e.g. 6014) in a commercial T7 temper may be prepared by practice of the thermal treatment 60 shown in FIG. 7 and comprising:

a solution treatment 62, conducted at a temperature of about 535° C. for about one hour followed by quenching into water at room temperature or about 25° C.; and an overaging step 64, comprising exposing the sheet to about 175° C. for about 12 hours This process will promote the microstructure schematically shown at 70 where coarse precipitates 72 are formed substantially within aluminum grains 73 in combination with large precipitates 74 formed on aluminum grain boundaries 76.

Example 3

Figure 8:
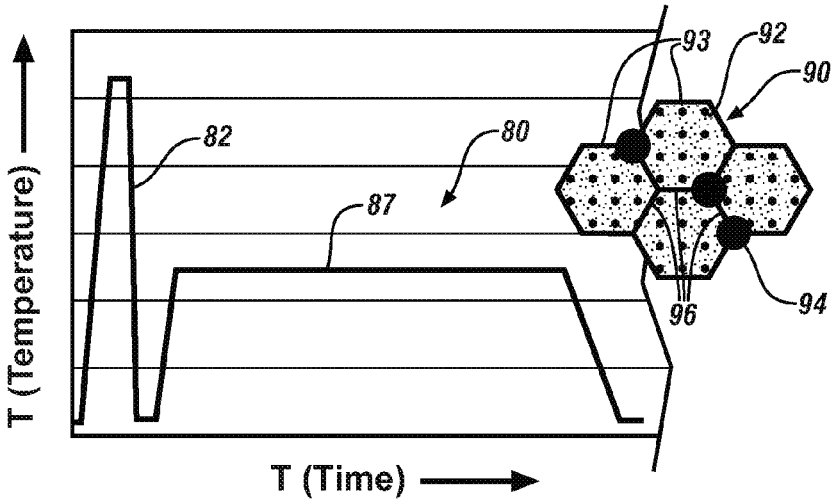
FIG. 8 shows a schematic time-temperature profile and resulting microstructure generally corresponding to a second T7 overaging treatment comprising: holding at a temperature of about 535° C. for about one hour and quenching; pre-straining to about 5% strain; and, aging at 250° C. for about 12 hours

A 6xxx series overaged aluminum sheet (e.g. 6014) in a commercial T7 temper may be prepared by practice of the thermal treatment 80 shown in FIG. 8 and comprising:

a solution treatment 82, conducted at a temperature of about 535° C. for about one hour followed by quenching into water at room temperature or about 25° C.; and an overaging step 84, comprising exposing the sheet to about 250° C. for about 12 hours.

This process will promote the microstructure schematically shown at 90 where coarse precipitates 92 are formed substantially within aluminum grains 93 in combination with large precipitates 94 formed on aluminum grain boundaries 96.

It may be noted that the precipitates, both grain boundary 96 and intergranular 92 are coarser than those formed at the lower overaging temperature of Example 2. It will be appreciated also, that after each of solutionizing treatments 42, 62, 82, some room temperature aging may occur depending on how long the sample is maintained at room temperature before passing to the aging or overaging treatments 48, 64, 84.

Figure 9:
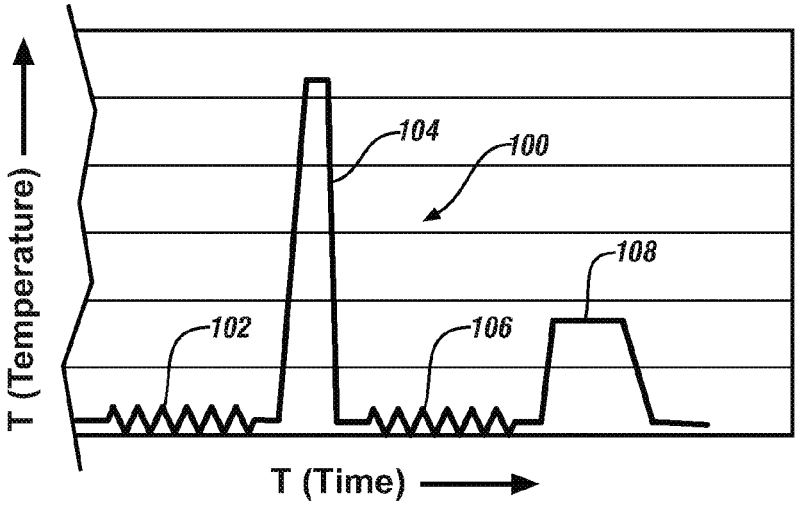
FIG. 9 shows a schematic of the forming and thermal processing to form a stamped component by the practice of this invention.

FIG. 9, which may be appended to any of FIGS. 6-8 to represent the entirety of the process shows process 100 comprising preform fabrication (deformation) 102; followed by solutionizing heat treatment 104 comprising heating the preform to a temperature of about 500° C. for a period of between 10 and 60 minutes; followed by the final stamping operation to produce the fully-formed part; and followed by an aging process 108. As noted a wide range of aging process temperatures and corresponding aging times may be employed, such as holding the component at a temperature of up to 200° C. for up to one hour.

The detailed practices shown are merely representative of the range of heat treatments which may be applied to aluminum alloys in practice of this invention. Those skilled in the art will recognize that specific heat treatment schedules (time and temperature) may be preferred for specific alloys. For example, as shown in Table 2, the solutionizing time and temperature vary slightly even within a specific alloy family (cf. 6111 and 6013). More dramatic differences are apparent between alloy families (cf. 6xxx and 7xxx alloys). Similarly a range of aging schedules are preferred, both one-step and two-step, and multiple aging treatments may be acceptable or preferred even for a single alloy as indicated for alloy 6111.

TABLE 2

| Alloy | Solutionizing Heat Treatment Temp/Time | T7 Overaging Heat Treatment Temp/Time |
|---|---|---|
| 6111 | 560° C./30 minutes | 175° C./12 hours |
| 6111 | 560° C./30 minutes | 170° C./6 hours then 250° C./4 hours |
| 6013 | 570° C./30 minutes | 190° C./8 hours |
| 7075 | 480° C./30 minutes | 105° C./8 hours then 165° C./24 hours |

Hence, although the practice of the invention has been illustrated through reference to certain preferred embodiments; such embodiments are intended to be exemplary, and not limiting. The full scope of the invention is to be defined and limited only by the following claims.

The invention claimed is:

1. A method of forming a stamped component from an age-hardenable, aluminum-based alloy sheet metal workpiece, the aluminum-based alloy comprising alloying elements that form an aluminum-rich solid solution comprising at least 85% by weight of aluminum when the alloy is heated to a solutionizing temperature, the alloying elements precipitating from the aluminum-rich solid solution over time at temperatures below the solutionizing temperature to progressively age-harden the workpiece material; the method comprising;

preparing an overaged aluminum alloy by solutionizing the alloy to substantially dissolve the alloying elements and form the aluminum-rich solid solution, rapidly cooling the alloy at a sufficiently rapid rate to maintain the alloying elements in solution in the aluminum-rich solid solution, aging the alloy to peak strength and continuing to age the alloy until its strength is less than 90% of its peak aged strength;

forming, by stamping, an unheated workpiece sheet of the overaged aluminum alloy to produce a preform sheet with a shape intermediate between that of the workpiece and the component, the preform sheet having no splits, necks or folded metal;

heating at least a portion of the preform sheet to a temperature and holding for a time sufficient to dissolve substantially all of the alloying elements into the aluminum-rich solid solution produced in the heated portion of the preform sheet;

rapidly cooling the preform to retain the dissolved alloying elements in the aluminum-rich solid solution in the heated portion of the preform sheet;

further forming the preform, by stamping, to fully form the component, the component having no splits or necks; and exposing the fully-formed component to a temperature between room temperature and 250° C. for a time sufficient to age-harden and strengthen the component.

2. The method of forming a stamped aluminum component from an age-hardenable aluminum alloy as set forth in claim 1, wherein the same set of dies is used to press form the preform and to press form the fully-formed component.

3. The method of forming a stamped aluminum component from an age-hardenable aluminum alloy as set forth in claim 1, wherein different sets of dies are used to press form the preform and to press form the fully-formed component.

4. The method of forming a stamped aluminum component from an age-hardenable aluminum alloy as set forth in claim 1 further comprising the step of trimming the preform.

5. The method of forming a stamped aluminum component from an age-hardenable aluminum alloy as set forth in claim 1, wherein the overaged alloy sheet is in a T7 temper condition.

6. The method of forming a stamped aluminum component from an age-hardenable aluminum alloy as set forth in claim 1, wherein the overaged alloy sheet is in an overaged T8 temper condition.

7. The method of forming a stamped aluminum component from an age-hardenable aluminum alloy as set forth in claim 1, wherein the aluminum alloy is one of a 6000 series or 7000 series alloy.

8. The method of forming a stamped aluminum component from an age-hardenable 6000 series aluminum alloy as set forth in claim 7, wherein the aluminum alloy is one of the group consisting of 6013, 6014, 6111 and 6022.

9. The method of forming a stamped aluminum component from an age-hardenable 7000 series aluminum alloy as set forth in claim 8 wherein the aluminum alloy is one of the group consisting of 7050, 7075 and 7150.

10. The method of forming a stamped aluminum component as set forth in claim 1 wherein the preform is heated in a furnace.

11. The method of forming a stamped aluminum component as set forth in claim 1 wherein the preform is induction heated.

12. The method of forming a stamped aluminum component as set forth in claim 1 wherein the time and temperature exposure undergone by the fully-formed component occurs during a paint bake process.

13. The method of forming a stamped aluminum component as set forth in claim 12 wherein the paint bake process comprises a temperature of between 160° C. and 200° C. for a time of between 20 and 60 minutes.

14. A method of forming a stamped article of a predetermined three-dimensional shape from an age-hardenable, aluminum-based alloy sheet metal workpiece, the aluminum-based alloy comprising alloying elements that form a solid solution in a granular aluminum-rich matrix comprising at least 85% by weight of aluminum when the alloy is heated to a solutionizing temperature and that remain in solid solution after the alloy has been quenched from the solutionizing temperature to a temperature for forming by stamping, the alloying elements precipitating from the aluminum-rich matrix, over time, at temperatures below the solutionizing temperature, including the stamping temperature, to progressively age-harden the workpiece material; the method comprising;

preparing an age-hardened sheet metal stamping blank in which the aluminum-based alloy material has been age-hardened to an overaged condition in which the alloy material has been aged past its peak aged strength to a strength no greater than ninety percent of its peak-aging strength, the strain-limiting, forming properties of the stamping blank having been determined to form a predetermined preform shape with strained regions less than the strain inherent in the predetermined three-dimensional shape and without stamping strain damage to the preform shape;

forming, by stamping, an unheated stamping blank of the overaged aluminum alloy to produce the predetermined preform shape;

heating at least a portion of the preform sheet to a temperature and holding for a time sufficient to dissolve substantially all of the alloying elements into the aluminum matrix in the heated portion of the preform sheet;

rapidly cooling the preform to retain the dissolved alloying elements in the aluminum matrix; and forming the preform, by stamping, to obtain the determined three-dimensional shape of the stamped article.

* * * * *